US008469535B2

(12) United States Patent
Guzman

(10) Patent No.: US 8,469,535 B2
(45) Date of Patent: Jun. 25, 2013

(54) INTERACTIVE LIGHTED FOOTWEAR

(75) Inventor: Rudy Guzman, Coral Springs, FL (US)

(73) Assignee: BBC International LLC, Boca Raton, FL (US)

( * ) Notice: Subject to any disclaimer, the term of this patent is extended or adjusted under 35 U.S.C. 154(b) by 402 days.

(21) Appl. No.: 12/817,533

(22) Filed: Jun. 17, 2010

(65) Prior Publication Data

US 2011/0308114 A1 Dec. 22, 2011

(51) Int. Cl.
*F21V 21/08* (2006.01)
*A43B 23/00* (2006.01)

(52) U.S. Cl.
USPC ..... 362/103; 36/137

(58) Field of Classification Search
USPC ..... 362/103; 36/137
See application file for complete search history.

(56) References Cited

U.S. PATENT DOCUMENTS

| | | | | |
|---|---|---|---|---|
| 4,254,451 | A | | 3/1981 | Cochran, Jr. |
| 4,848,009 | A | | 7/1989 | Rodgers |
| 5,113,325 | A | | 5/1992 | Eisenbraun |
| 5,128,843 | A | | 7/1992 | Guritz |
| 5,159,768 | A | | 11/1992 | Longo, Jr. |
| 5,343,190 | A | | 8/1994 | Rodgers |
| 5,357,696 | A | | 10/1994 | Gray et al. |
| 5,455,749 | A | | 10/1995 | Ferber |
| 5,461,188 | A | | 10/1995 | Drago et al. |
| 5,649,376 | A | | 7/1997 | Lecates, Jr. |
| 5,714,706 | A | | 2/1998 | Nakada et al. |
| 5,812,063 | A | | 9/1998 | Weng et al. |
| 5,813,148 | A | | 9/1998 | Guerra |
| 5,855,080 | A | | 1/1999 | Van Staden |
| 5,894,201 | A | | 4/1999 | Wong |
| 5,894,686 | A | * | 4/1999 | Parker et al. ..... 36/137 |
| 5,903,103 | A | | 5/1999 | Garner |
| 5,909,088 | A | | 6/1999 | Wut |
| 5,932,975 | A | | 8/1999 | Wut |
| 5,945,911 | A | | 8/1999 | Healy et al. |
| 5,969,479 | A | | 10/1999 | Wong |
| 6,012,822 | A | | 1/2000 | Robinson |
| RE37,220 | E | | 6/2001 | Rapisarda et al. |
| 6,278,378 | B1 | | 8/2001 | Feiner et al. |
| 6,286,975 | B1 | | 9/2001 | Rodgers |
| 6,525,487 | B2 | | 2/2003 | Wei |
| 5,821,858 | C1 | | 6/2003 | Stone |
| 7,059,070 | B2 | * | 6/2006 | Omstead et al. ..... 36/137 |
| 7,114,822 | B2 | | 10/2006 | Guzman |
| 7,178,929 | B2 | | 2/2007 | Guzman |
| 7,246,455 | B2 | | 7/2007 | Covington |
| 2004/0172856 | A1 | | 9/2004 | Horchler et al. |
| 2005/0183294 | A1 | | 8/2005 | Guzman |
| 2007/0089320 | A1 | | 4/2007 | Denfeld |
| 2009/0193689 | A1 | | 8/2009 | Galica et al. |

* cited by examiner

*Primary Examiner* — Stephen F Husar
*Assistant Examiner* — James Cranson, Jr.
(74) *Attorney, Agent, or Firm* — GrayRobinson, PA

(57) ABSTRACT

An article of footwear is provided having an array of light sources and a loudspeaker wherein the light sources are illuminated in a flashing pattern in response to activation of a motion switch, and in another mode of operation triggered by operation of a manual switch both the light sources and loudspeaker cycle through a series of discrete sequences of flashes and beeps culminating with only one light source remaining illuminated.

5 Claims, 2 Drawing Sheets

INTERACTIVE LIGHTED FOOTWEAR

FIELD OF THE INVENTION

This invention relates to articles of footwear, and, more particularly, to a shoe having an array of light sources such as LEDs and a loudspeaker wherein the LEDs are activated by operation of an inertia switch and both the LEDs and loudspeaker are activated by operation of a manual switch in a series of sequential flashes and beeps that culminate with only one LED illuminated.

BACKGROUND OF THE INVENTION

For a number of years, articles of footwear and various items of clothing have been sold with decorative arrays of light sources such as light emitting diodes LEDs) and/or a loudspeaker capable of producing sounds. This has been particularly popular in children's shoes where the LEDs are arranged to complement other design elements of the shoe such as cartoon characters, toy cars and the like.

In a typical design of a children's shoe of the type noted above, a module including a plastic housing is placed in a cavity usually formed in the heel area of the shoe. The module mounts a battery, a switch and, conventionally, an integrated circuit which is connected by wires to LEDs positioned along the outsole, upper or tongue of the shoe. The integrated circuit may also be capable of generating a signal which operates a loudspeaker, typically mounted in the upper or tongue of the shoe in the general area of the LEDs. Systems of this type are shown, for example, in U.S. Pat. Nos. 6,525,487; 6,286,975; 6,012,822; 5,969,479; 5,894,201; 5,812,063 and others.

The integrated circuits employed in modules for children's shoes and other applications are activated by one or more switches carried on or otherwise coupled to the module. In some designs, the switch turns on and off in response to the application of an inertial force, pressure or motion. Spring switches such as disclosed in U.S. Pat. Nos. RE37,220 and 5,909,088 are a popular choice for children's shoes because they are reliable, noiseless and movable from a neutral or off position to a closed or on position in response to walking, running or other motion of the shoe. Pressure switches such as shown in U.S. Pat. Nos. 5,159,768; 5,649,376; 5,855,080 and 5,714,706 are also employed and they operate in response to the application of a weight, e.g. when the shoe makes contact with a surface.

Another type of switch employed in children's shoes and similar applications is a manually activated switch such as shown in U.S. Pat. Nos. 5,894,686; 6,278,378 and 5,813,148. Manual switches are used to turn on and off the light source carried by the shoe, to select different modes of operation for the integrated circuit associated with the shoe, e.g. different flashing sequences or other operations, and for other purposes. Some systems, such as disclosed in the U.S. Pat. No. 5,813,148, employ both manual and inertial switches to activate light sources and/or sound sources associated with the shoe. In the '148 system, the manual switch turns on and off a light source, and also causes a controller including an integrated circuit to activate a particular mode of operation. One of the modes of operation enables an inertia or pressure sensitive switch, which then operates to activate the light source in a selected flashing sequence.

All of these arrangements involve either the "automatic" activation of the lights sources and/or loudspeaker in the sense that an inertia, pressure, motion or similar switch operates without manual intervention, or, alternatively, manual switches associated with the shoe are operated to activate the light sources and/or loudspeakers. In either case, a switch or switches carried by the shoe cause the light sources or loudspeaker to operate.

SUMMARY OF THE INVENTION

This invention is directed to an article of footwear having an array of light sources such as LEDs and a loudspeaker wherein the LEDs are activated by operation of an inertia switch and both the LEDs and loudspeaker are activated by operation of a manual switch in a series of sequential flashes and beeps that culminate with only one LED illuminated.

In the presently preferred embodiment, an article of footwear such as a shoe is provided with an array of different colored LEDs and at least one loudspeaker coupled to a light module having a housing within which a battery, integrated circuit (IC) and a motion switch are located. A manually-operated switch is connected to the light module, and is preferably mounted to the upper. In one mode of operation, the LEDs illuminate in a flashing pattern in response to movement of the shoe. When the manual switch is activated, the IC is effective to cause the LEDs and the loudspeaker to cycle through at least two sequences of operation. Each sequence of operation involves illuminating the LEDs in a flashing pattern and causing the loudspeaker to beep. Initially, in a first sequence of operation, both the LEDs and loudspeaker flash and beep at a relatively rapid pace followed by a second sequence of operation in which the flashes and beeps are slower. Any number of such operational sequences may be employed. At the end of a final sequence of operation, only one of the LEDs remains illuminated, preferably in a flashing pattern, and the loudspeaker sounds a number of beeps, both to signify that such one LED is the "winner" for the enjoyment of the child wearing the shoe.

DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
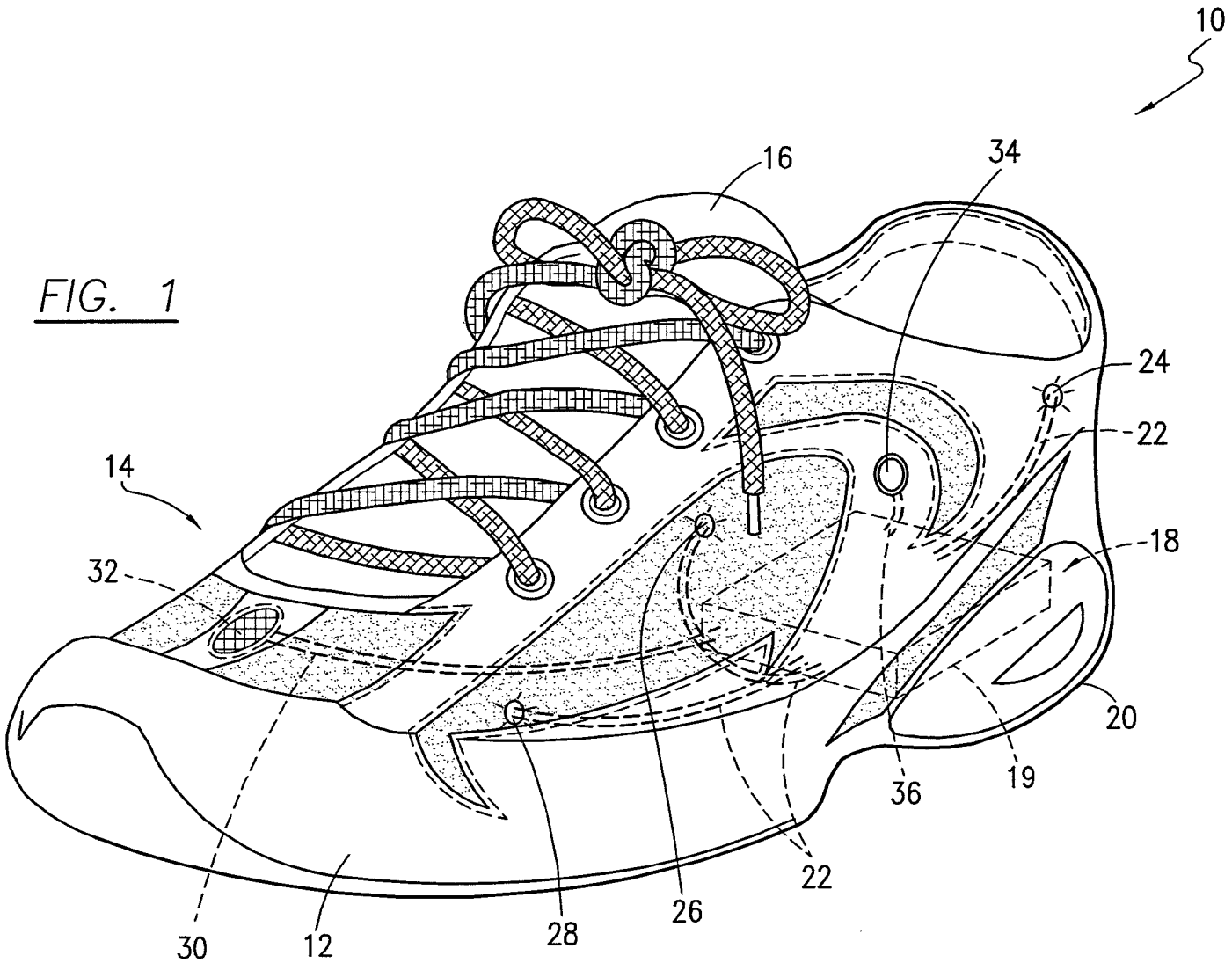
FIG. 1 is a perspective view of a shoe having a light module which is connected to an array of LEDs and to a loudspeaker both mounted to the upper of the shoe.

Referring now to the drawings, an article of footwear such as a shoe 10 is shown having an outsole 12 connected to an upper 14 including a tongue 16. It should be understood that any other article of footwear is considered within the scope of this invention, and the shoe 10 is shown for purposes of illustration. As such, the term "upper" is meant to broadly encompass essentially any shoe element mounted to the outsole of an article of footwear such as the straps of a sandal, etc.

A light module 18 having a housing 19 preferably made of plastic is mounted in the heel 20 of the shoe 10. A cavity (not shown) is hollowed out of the heel 20 to receive the module 18, over which the sock liner or insole of the shoe 10 is secured. As schematically illustrated in FIG. 1, the module 18 is connected by wires 22 to an array of LEDs 24, 26 and 28 mounted to the upper 14 of the shoe 10, and by a wire 30 to a loudspeaker 32 which is also carried by the upper 14. A manually-operated push button switch 34 is preferably mounted to the upper 14, and connected by a wire 36 to the module 18. The particular location or arrangement of the LEDs 24, 26 and 28 on the shoe 10 is a matter of choice, and it is contemplated they could be placed on the outsole 12, the upper 14 the tongue 16 or in essentially any other position on the shoe 10. The loudspeaker 32 is preferably mounted to the tongue 16 or some area of the upper 14, rather than on the outsole 12.

In the presently preferred embodiment, each of the LEDs 24, 26 and 28 illuminates in a different color, i.e. red for LED 24, green for LED 26 and yellow for LED 28, for example. It should be understood that essentially any number of LEDs could be employed, and different colors may be chosen instead of, or in addition to, red, green and yellow. As discussed below in connection with a description of the operation of the shoe 10, the different colored LEDs 24-28 enhance the visual enjoyment of the shoe 10 and allow the LEDs 24-28 to be readily distinguished from one another. Additionally, the LEDs 24-28 are shown in FIG. 1 mounted to one side of the upper 14 that is devoid of design elements. It is contemplated that the LEDs 24-28 may be positioned in association with various design elements such as cartoon characters, toy cars and the like.

Figure 2:
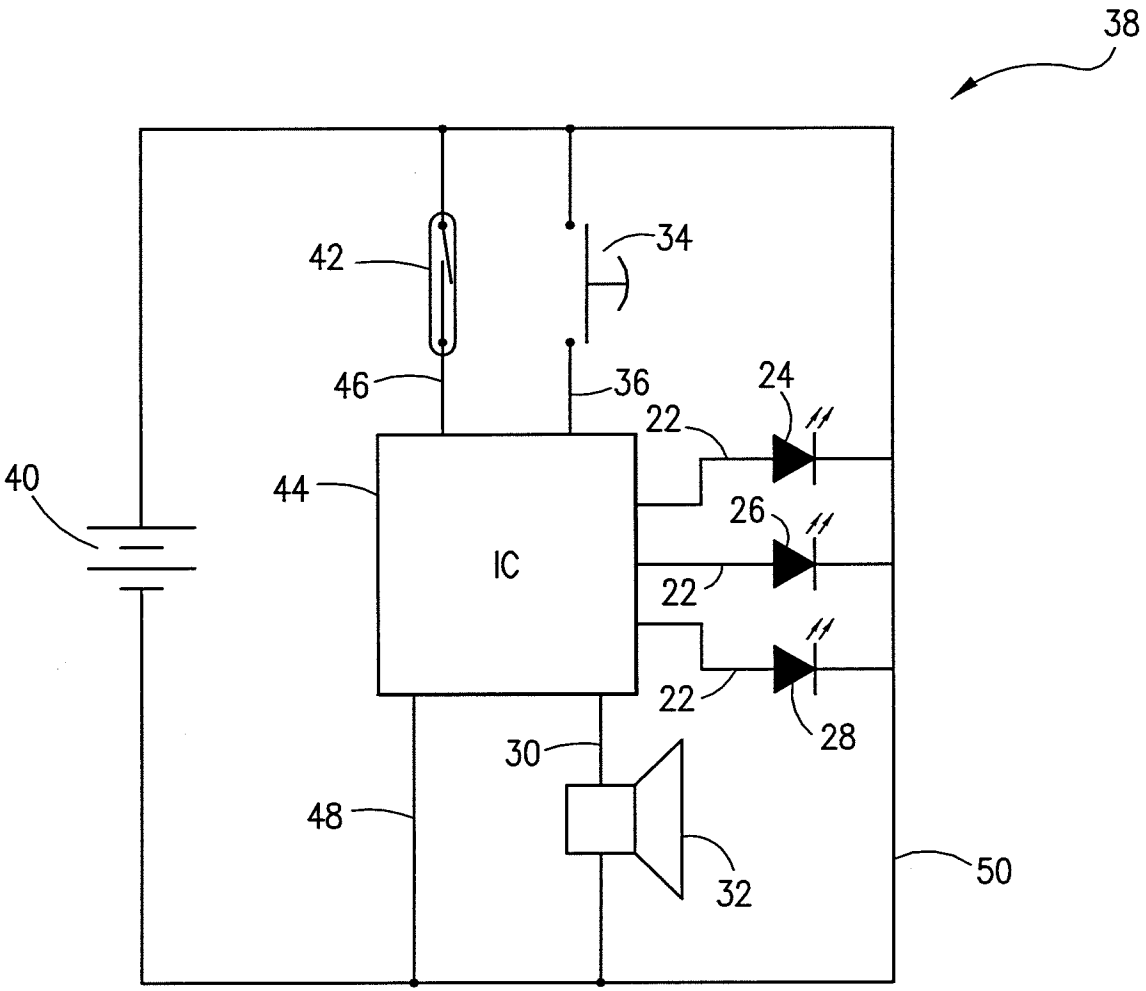
FIG. 2 is a schematic circuit diagram of one embodiment of the electrical circuit associated with the shoe of FIG. 1.

Referring now to FIG. 2, an electrical circuit 38 is schematically depicted which includes a battery 40, a spring switch 42, an integrated circuit (IC) 44, the LEDs 24, 26 and 28, the loudspeaker 32 and the manual, push button switch 34. For purposes of the present discussion, the IC 44 is considered a "controller." The battery 40, IC 44 and spring switch 42 are preferably mounted inside of the housing 19 of the module 18. In one presently preferred embodiment, the spring switch 42 is connected by a line 46 to the IC 44, which, in turn, is connected by line 48 to the battery 40. As noted above, wires 22 connect the IC 44 with the LEDs 24-28, which, in turn, are connected via line 50 to the battery 40. The manual push-button switch 34 is connected to the IC 44 by wire 36, and the loudspeaker 32 is connected to the IC 44 by wire 30, as discussed above.

The electrical circuit 38 operates as follows. In response to motion of the shoe 10, such as by walking or running, the spring switch 42 is actuated and the IC 44, in turn, causes the LEDs 24-28 to illuminate, preferably in a flashing pattern. Such flashing pattern may involve sequential lighting of the LEDs 24-28, flashing on and off in unison, flashing for a predetermined number of times etc. While a spring switch 42 is depicted in FIG. 2, it should be understood that any other type of motion or inertia switch may be employed or a pressure switch mounted to the bottom surface of the outsole 12 in position to engage the surface upon which the wearer of the shoe 10 is walking or running.

The interactive aspect of the shoe 10 of this invention is realized when the wearer of the shoe 10 depresses the manual, push button switch 34. In response to pressing on the push button switch 34, the IC 44 is effective to operate the LEDs 24-28 and the loudspeaker 32 in a series of discrete, consecutive modes or sequences. A first sequence of operation may include the IC 44 causing the LEDs 24-28 to illuminate in a flashing pattern in which they turn on and off at a rapid rate a number of times, accompanied by sounding of the loudspeaker 32 at substantially the same rate. The speed at which the LEDs 24-28 turn on and off, and at which the loudspeaker 32 "beeps" or otherwise sounds, may vary as desired. Further, the LEDs 24-28 may turn on and off in essentially any sequence, or in unison, and the number of times the LEDs turn on and off and the loudspeaker 32 sounds may be 3, 5, 10 or any other number. A second sequence of operation may include the IC 44 causing the LEDs 24-28 to illuminate in a flashing pattern in which they turn on and off at a rate that is slower than that of the first mode of operation, accompanied by sounding of the loudspeaker 32 at substantially the same rate.

The number of sequences of operation discussed above may be varied as desired. Preferably, although not necessarily, the speed or frequency at which the LEDs 24-28 turn on and off, and at which the loudspeaker 32 sounds, progressively decreases from the first sequence of operation to those sequences of operation that follow until the final sequence of operation is reached. In the presently preferred embodiment, at the end of the final sequence of operation only one of the LEDs 24, 26 or 28 is illuminated, in a flashing pattern or otherwise, accompanied by sounding of the loudspeaker 32 a selected number of times.

The operation of the shoe 10 of this invention has the effect of a "race" to denote a "winning" LED 24, 26 or 28. The progressive decrease in the frequency with which the LEDs 24-28 flash and the loudspeaker 32 sounds ultimately ends in the final sequence of operation where the only LED 24, 26 or 28 that remains illuminated signifies that it is the winning LED. As noted above, the LEDs 24-28 are of different color, and this enhances visualization of the "race" and assists the wearer of the shoe 10 in readily identifying the winning LED.

Once the IC 44 has operated the LEDs 24-28 and the loudspeaker 32 through each of a number of sequences of operation, culminating with the final sequence, the shoe 10 functions normally, e.g. with the LEDs 24-28 flashing in response to motion of the shoe 10, until such time as the manual push button switch 34 is again depressed to resume the "race" for the "winning" LED.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. An article of footwear, comprising:

an outsole, and an upper mounted to said outsole;

an electrical circuit mounted to at least one of said outsole and said upper, said electrical circuit comprising:

(i) a power source;

(ii) a loudspeaker;

(iii) an array of light sources;

(iv) a controller coupled to said power source, to said loudspeaker and to said light sources;

(v) a motion responsive switch coupled to said controller, said controller being effective in response to receipt of a first signal from said motion responsive switch to cause said light sources to illuminate without operating said loudspeaker;

(vi) a manually operated switch coupled to said controller, said controller being effective in response to receipt of a second signal from said manually operated switch to cause said light sources to illuminate in a flashing pattern, and to cause said loudspeaker to sound on and off, both in a series of discrete sequences of operation from a first sequence of operation to a final sequence of operation, the frequency at which said light sources flash and said loudspeaker sounds progressively decreasing from said first sequence to said final sequence and at the end of said final sequence only one of said light sources remains illuminated, said controller being effective at the completion of said final sequence of operation and in response to receipt of another first signal from said motion responsive switch to cause said light sources to illuminate without operating said loudspeaker.

2. The article of footwear of claim 1 in which said array of light sources comprises a number of light emitting diodes at least some of which are of different color.

3. The article of footwear of claim 1 in which said controller operates said loudspeaker to emit sounds during each of said sequences of operation at substantially the same frequency as said flashing pattern of said light sources.

4. The article of footwear of claim 1 in which said only one light source illuminates at the end of said final sequence of operation.

5. The article of footwear of claim 1 in which said controller operates said loudspeaker to emit a series of sounds at the end of said final sequence of operation.

* * * * *